US006170105B1

(12) United States Patent
Doyle et al.

(10) Patent No.: US 6,170,105 B1
(45) Date of Patent: Jan. 9, 2001

(54) COMPOSITE DECK SYSTEM AND METHOD OF CONSTRUCTION

(75) Inventors: John J. Doyle, Cincinnati; Kurt S. Eyring, Centerville; Ken R. Schibi, Cincinnati, all of OH (US)

(73) Assignee: Composite Deck Solutions, LLC, Dayton, OH (US)

( * ) Notice: Under 35 U.S.C. 154(b), the term of this patent shall be extended for 0 days.

(21) Appl. No.: 09/301,938

(22) Filed: Apr. 29, 1999

(51) Int. Cl.[7] ..... E01D 19/12

(52) U.S. Cl. ..... 14/73; 14/6; 52/601; 156/166; 156/180

(58) Field of Search ..... 14/6, 73, 77.1; 52/87, 88, 89, 745.2, 602, 601, 600; 156/180, 166, 245, 242

(56) References Cited

U.S. PATENT DOCUMENTS

| | | | | |
|---|---|---|---|---|
| 3,238,682 | * | 3/1966 | Tracy et al. | 52/87 |
| 3,333,517 | * | 8/1967 | Kohler | 156/180 |
| 5,425,152 | | 6/1995 | Teron . | |
| 5,471,694 | * | 12/1995 | Meheen | 14/73 |
| 5,650,109 | | 7/1997 | Kaiser et al. . | |
| 5,826,290 | * | 10/1998 | Kokonis | 14/73.1 |
| 5,876,553 | * | 3/1999 | Kaiser | 156/433 |
| 6,007,656 | * | 12/1999 | Heikkila et al. | 156/180 |
| 6,054,177 | * | 4/2000 | Endoh et al. | 156/180 |

* cited by examiner

*Primary Examiner*—Eileen D. Lillis
*Assistant Examiner*—Raymond W Addie
(74) *Attorney, Agent, or Firm*—Jacox, Meckstroth & Jenkins

(57) ABSTRACT

Elongated composite deck sections or panels are formed by pultruding a plastics resin material with multiple layers or mats of glass fibers and longitudinally extending unidirectional fibers to form a base wall integrally connecting upwardly projecting and longitudinally extending tubular ribs. Each rib has opposite side surfaces converging towards the base wall, and longitudinally extending ears project laterally outwardly from the side surfaces. The top surface of each panel is coated with epoxy adhesive, and the top surface of the base wall is also coated with an aggregate of crushed stone. The deck panels are assembled in laterally adjacent overlapping relation to form a permanent composite deck form. A mat of fiber reinforced composite rods are spaced above the deck panels which are surrounded by border forms, and concrete is poured onto the deck panels which positively bond with the concrete. Vertical steel studs are welded to steel frame members which support the composite deck panels and project upwardly into the concrete to tie the concrete to the frame members. Angle support strips are attached to center support beams to provide a bridge deck system with a crown.

24 Claims, 2 Drawing Sheets

COMPOSITE DECK SYSTEM AND METHOD OF CONSTRUCTION

BACKGROUND OF THE INVENTION

In the construction and repair of concrete bridge decks, it is common to position a plurality of corrugated sheet steel panels in an overlapping manner on steel support beams for the deck to provide a permanent base form, and the panels may have various corrugated cross-sectional configurations. A wood or steel form is installed around the periphera of the assembled deck panels, and the steel peripheral forms may be attached to the steel deck panels to remain as permanent forms with the deck panels. Upper and lower layers or grids of reinforced steel rods or rebars are positioned at predetermined levels above the steel deck panels, and concrete is poured onto the deck panels up to the top level of the peripheral forms.

The problem of corrosion of the steel deck panels and the steel reinforcing rods or rebars within the concrete over a period of years is well known. Such corrosion is caused by atmospheric pollutants, road salt, vehicle emissions, acid rain and other pollutants. Over a period of years, the concrete decks deteriorate due to water seeping through pores and cracks within the concrete and contacting the steel reinforcement rods, causing them to corrode. Eventually, the support strength of the steel and concrete deck significantly reduces, thus requiring either reconstruction or replacement of the bridge deck. In order to avoid corrosion of the corrugated steel deck panels, it is known to use precast concrete panels which have embedded reinforcement, for example, as disclosed in U.S. Pat. No. 5,425,152. The precast concrete deck panels may also form parallel spaced concrete beams which may be prestressed or post-tensioned with reinforcing cables.

SUMMARY OF THE INVENTION

The present invention is directed to an improved composite deck system which is ideally suited for use in constructing bridge decks, and to the method of constructing the deck system. The deck system of the invention provides excellent corrosion resistance and thereby significantly increases the service life of bridge decks. The composite deck system also provides a cost effective or relatively inexpensive solution to forming a non-corrosive deck which is capable of supporting a substantial load over a long period of time. The deck system of the invention further enables the use of established design values for composite reinforcing materials in concrete so that bridge decks of various sizes and characteristics may be designed using conventional methods for designing bridge decks.

In accordance with a preferred embodiment of the invention, elongated composite deck sections or panels are formed by pultruding a plastics resin material with longitudinally extending mats of glass fibers and longitudinally extending unidirectional fibers to form a base wall integrally connecting upwardly projecting and longitudinally extending tubular ribs each having a generally square cross-sectional configuration. The opposite side surfaces of each rib converge slightly towards the base wall, and longitudinally extending ribs or ears project laterally outwardly from the side surfaces to aid in resisting potential vertical shearing at the concrete and composite panel interfaces. The pultrusion is cut into sections or panels of predetermined lengths, and the top surface of each deck panel is coated with epoxy adhesive and an aggregate of crushed stone to protect the deck section against alkaline attack from concrete and to provide positive bonding to concrete.

The deck panels are positioned or assembled in laterally adjacent overlapping relation and span parallel spaced steel frame members or beams to form a permanent pultruded deck form. A mat or grid of fiber reinforced composite rods are spaced above the deck panels, and vertical steel studs are welded to the steel beams which support the composite deck panels. The studs project upwardly into a concrete layer which is poured onto the deck panels to a predetermined level above the composite reinforcing rods.

Other features and advantages of the invention will be apparent from the following description, the accompanying drawings and the appended claims.

DESCRIPTION OF THE PREFERRED EMBODIMENTS

Figure 1:
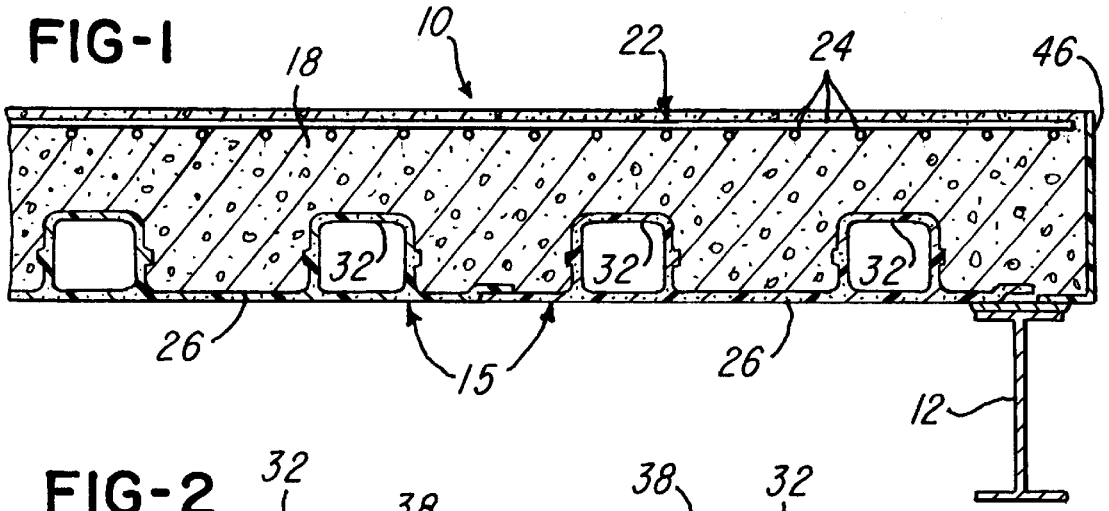
FIG. 1 is a fragmentary vertical section of a composite deck system constructed in accordance with the invention.

FIG. 1 illustrates a deck assembly or system 10 which spans a frame of parallel spaced steel support beams 12 which typically form the framework for a bridge. The deck system 10 includes a plurality of elongated and overlapping pultruded composite deck sections or panels 15. A concrete layer 18 is bonded to the deck panels and has an upper portion reinforced by a mat or grid 22 of pultruded composite reinforcing rods 24 each having longitudinally extending fibers bonded together by a plastics resin. Such reinforcing rods are produced, for example, by Marshall Industries Composites, Inc. in Lima, Ohio and are disclosed in U.S. Pat. No. 5,650,109.

Figure 2:
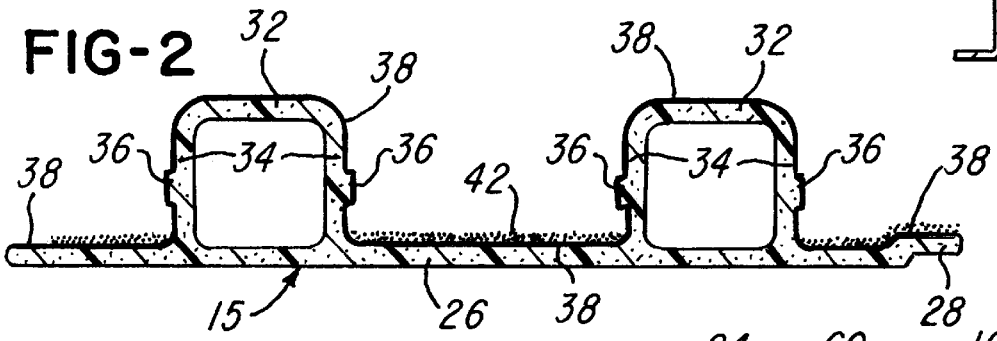
FIG. 2 is an enlarged cross-section of a composite deck panel constructed in accordance with the invention and used to form the deck system shown in FIG. 1.
Figure 3:
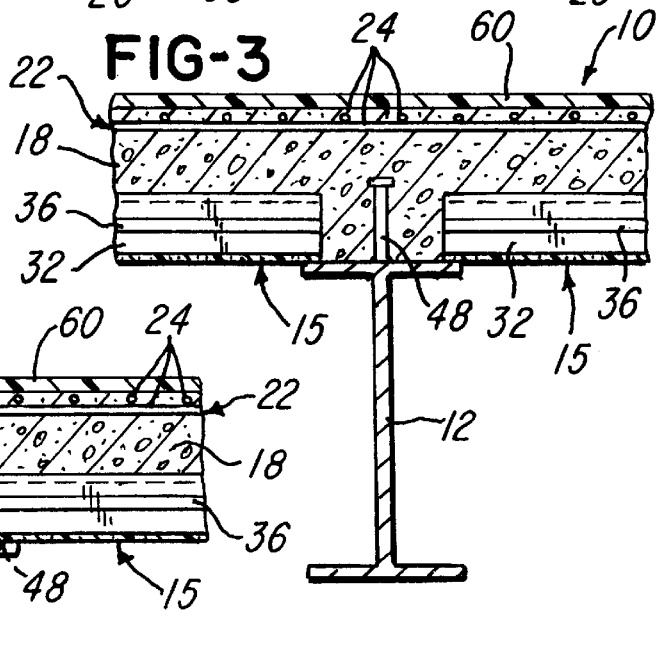
FIG. 3 is a fragmentary section of a composite deck system similar to that shown in FIG. 1 and with end portions of two pultruded deck panels supported by a steel support beam.
Figure 4:
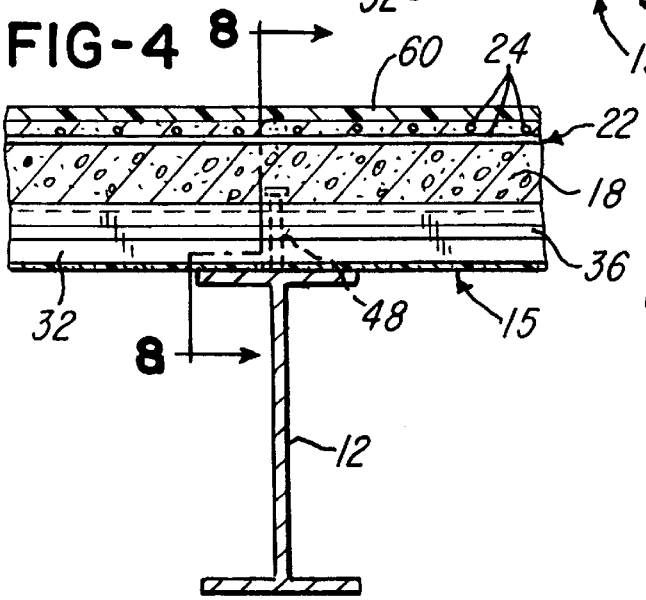
FIG. 4 is a fragmentary section similar to FIG. 3 and illustrating intermediate portions of the deck panels supported by a steel beam.

Referring to FIG. 2, each of the elongated composite deck sections or panels 15 is pultruded with multiple layers each having parallel spaced or longitudinally extending continuous fibers embedded in a plastics resin, and the fibers may be glass or carbon or high strength plastics material. Preferably, each base section or panel 15 comprises multiple individual layers of fiber reinforcing mat with the fiber content about 57% by volume and the resin content about 43% by volume. The fibrous mats or layers preferably have parallel elongated fibers oriented in different directions such as fibers which extend in +/−45° in one layer and unidirectional fibers in another layer. Each of the deck panels 15 includes a generally flat base wall 26 having one off-set longitudinally extending edge portion 28 for overlapping the opposite edge portion of an adjacent panel as shown in FIG. 1.

Each panel 15 also has a pair of longitudinally extending tubular ribs 32 each have a generally square cross-sectional configuration and integrally connected by the base wall 26. The ribs 32 project upwardly from the base wall generally to the center portion of the concrete layer 18, as shown in FIG. 1. Each of the ribs 32 has opposite side surfaces 34 which converge slightly towards the base wall 26, and a longitudinally extending minor rib or ear 36 projects laterally outwardly from each of the side surfaces 34. The top surface of the base wall 26 and the outer surfaces of each tubular rib 32 have a coating 38 of epoxy adhesive, and a layer 42 of aggregate or crushed stone is bonded by the epoxy coating 38 to the top surface of the base wall 26, as shown in FIG. 2.

The deck system 10 is installed on a support frame usually consisting of parallel spaced steel beams such as the I-beams 12 shown in FIGS. 1 and 3–8. The panels 15 are positioned so the edge portion 28 of each panel overlaps an edge portion of an adjacent panel, and the overlapping edge portions may be secured together by longitudinally spaced screws or fasteners (not shown). After the panels are arranged or positioned to form a deck form on the beams 12, L-shaped edge panels or forms 46 are secured to the beams 12 around the periphera of the deck form, and vertical steel studs 48 are welded to the top surfaces of the beams 12 at longitudinally spaced intervals.

Figure 8:
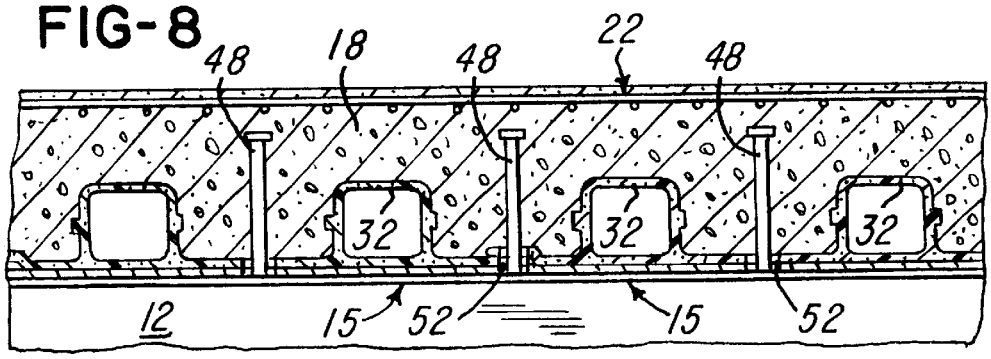
FIG. 8 is a fragmentary section of the deck system and taken generally on the line 8—8 of FIG. 4.

Referring to FIG. 8, when necessary, circular holes 52 are cut within the deck panels 15 to provide for inserting and welding the studs 48 to the beams 12. The mat or grid 22 of composite reinforcing rods 24 is positioned above the assembled deck panels 15 by suitable plastic support chairs (not shown) which are commercially available. The layer 18 of concrete is then poured onto the assembled deck panels 15 and through the reinforcing grid 22, and the top surface of the concrete layer 18 is leveled and finished with a screed.

Figure 5:
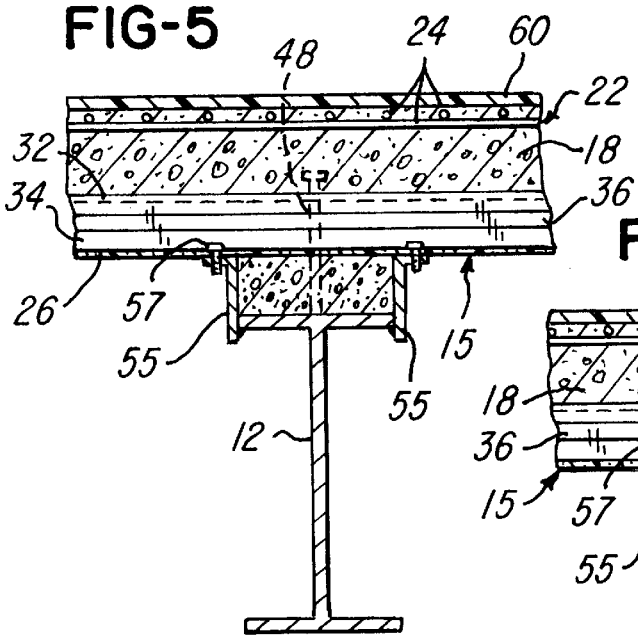
FIGS. 5 & 6 are fragmentary sections similar to FIGS. 3 & 4 and showing the support of a center portion of the deck panels to form a crown or haunch in the composite deck.
Figure 6:
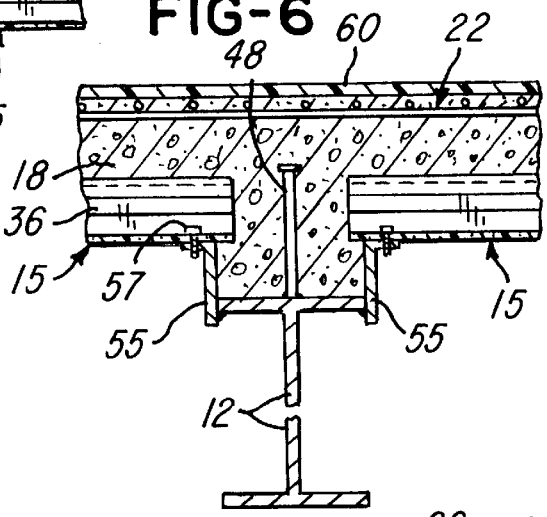
Figure 7:
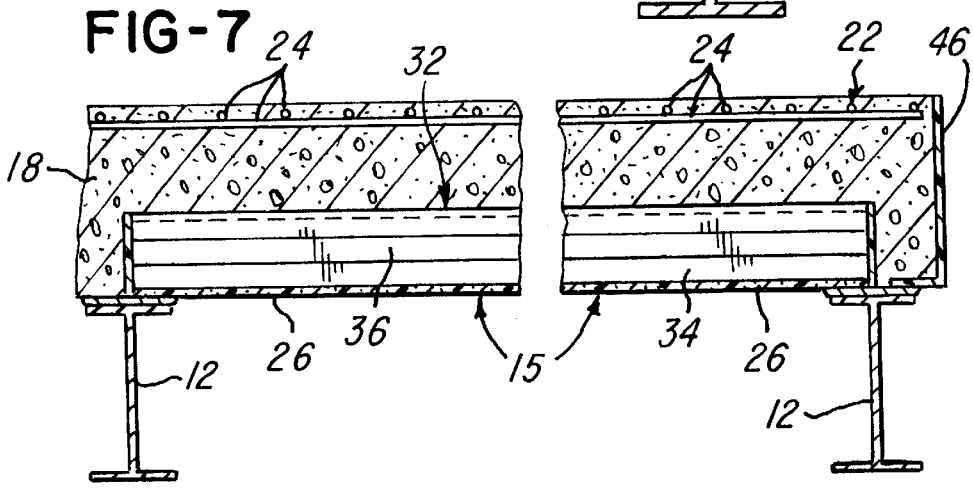
FIG. 7 is a fragmentary section of a deck system similar to that shown in FIG. 1 and with opposite end portions of the assembled deck panels supported by steel beams.

Referring to FIGS. 5 & 6, when it is desired to elevate center portions of the deck panels 15 to provide the deck system 10 with a crown or haunch in the center portion of the deck, L-shaped brackets or strips 55 are first welded to the top flange of the beams 12 before the deck panels 15 are assembled to establish the grade for the crown. Thus when the panels are assembled, the base walls of the panels are elevated above the support beams 12, and a series of screws 57 may be used to secure the deck panels 15 to the spacer strips 55. As also shown in FIGS. 5 & 6, concrete or mortar may be used to fill the space between parallel strips 55 to aid in supporting the center portion of the deck system in an elevated position above the beams. As also shown in FIGS. 3–6, an optional layer 60 of polymer or plastics material is coated over the concrete layer 18 to provide a high wearing texture surface for the deck system.

From the drawings and the above description, it is apparent that a deck system constructed in accordance with the present invention, provides desirable features and advantages. For example, the deck system provides for excellent corrosion resistance and a cost effective or relatively inexpensive solution to the problem of forming a non-corrosive bridge deck. As a result, the service life of a bridge deck is significantly increased. It is also apparent that the thickness of the concrete layer 18 may be selected according to the desired deflection and loading and that the pultruded base sections or panels 15 provide the main or primary tensile reinforcing means for the deck system. The mat 22 of composite reinforcing rods 24 provide for positively reinforcing the upper portion of the concrete layer 18 and prevent cracking of the concrete especially when the base panels 15 extend over a support beam. The configuration and treatment of each stay-in-place deck panel further provides for positive and permanent bonding of the concrete layer to the deck panels 15. This bonding is produced by the converging side surfaces 34 and the laterally projecting ears 36 on each rib 32 to form "undercuts" for the concrete, and by the layer 42 of aggregate or crushed stone bonded to the upper surfaces of the base wall 26 of each panel 15. The epoxy coating 38 extending over the entire top surface of each base panel 15 also provides protection of the deck panels against alkaline attack from the concrete layer 18. The tubular ribs 32 also produce voids in the concrete layer 18, thereby reducing the total weight of the deck system. As another important advantage, the deck system of the invention may be designed using established design values for composite material in concrete, and conventional methods for designing bridge decks may be used with the deck system.

While the form of deck system herein described and its method of construction constitute a preferred embodiment of the invention, it is to be understood that the invention is not limited to the precise method and form described, and that changes may be made therein without departing from the scope and spirit of the invention as defined in the appended claims.

We claim:

1. A method of constructing a deck system suited for use on a bridge, comprising the steps of forming a plurality of elongated deck panels of a composite fiber reinforced, plastic material and with each deck panel having a generally flat base wall and at least one upwardly projecting longitudinally extending rib, assembling the deck panels in laterally adjacent relation to provide a permanent deck form, pouring concrete onto the assembled deck panels to a predetermined level above a plurality reinforcing rods to form a concrete layer, and allowing the concrete layer to cure and bond to the deck panels.

2. The method of claim 1 wherein each of the deck panels is formed with at least one tubular rib projecting upwardly from the base wall with the rib closed by the base wall, and forming each tubular rib with spaced side walls having opposite outer side surfaces converging toward the base wall.

3. The method as defined in claim 2 wherein the side walls of each rib are formed with longitudinally extending and laterally projecting ears which cooperate with the converging side surfaces to form a positive bond of the concrete layer to the deck panels.

4. The method of claim 1 and including the step of coating a top surface of each deck panel with a layer of adhesive and stone aggregate material, before the step of pouring concrete onto the deck panels and allowing the layer to cure and harden to provide a positive bond between the concrete layer and the deck panel.

5. The method of claim 1 and including the steps of forming the base wall of each deck panel with a longitudinally extending offset edge portion, and overlapping opposite edge portions of adjacent deck panels.

6. The method of claim 1 and including the steps forming elongated composite rods each having resin bonded longitudinally extending fibers, and positioning the rods in spaced relation above the deck panels before pouring the concrete for reinforcing an upper portion of the concrete layer.

7. The method of claim 1 and including the step of anchoring a plurality of generally vertical studs to a beam supporting the deck panels, and projecting the stubs upwardly above the base walls of the deck panels for embedding the studs into the concrete layer.

8. The method of claim 1 and including the step of protruding longitudinally extending and laterally projecting ears on the ribs of the deck panels to aid in forming a positive bond of the concrete layer to the deck panels.

9. A method of constructing a deck system suited for use on a bridge, comprising the steps of forming a plurality of elongated deck panels of a composite, fiber-reinforced, plastics material and with each deck panel having a generally flat base wall and a plurality of upwardly projecting and parallel spaced longitudinally extending ribs, coating a top surface of each deck panel with a protective bonding material, assembling the deck panels in laterally adjacent relation to provide a permanent deck form, pouring concrete onto the assembled deck panels to a predetermined level above the reinforcing rods to form a concrete layer, and allowing the concrete layer to cure and bond to the deck panels.

10. The method of claim 9 wherein each of the deck panels is formed with the ribs being tubular and closed by the base wall, and forming each tubular rib with spaced side walls having opposite outer side surfaces converging toward the base wall.

11. The method as defined in claim 10 wherein the side walls of each tubular rib are formed with longitudinally extending and laterally projecting ears which cooperate with the converging side surfaces to form a positive bond of the concrete layer to the deck panels.

12. The method of claim 9 wherein the step of coating a top surface of each deck panel comprises applying a layer of adhesive and aggregate material to a top surface of the base wall, and allowing the layer to cure and harden to provide a positive bond between the concrete layer and the deck panel.

13. The method of claim 9 and including the steps of forming the base wall of each deck panel with a longitudinally extending offset edge portion, and overlapping opposite edge portions of adjacent deck panels.

14. The method of claim 9 and including the steps forming elongated composite rods each having resin bonded longitudinally extending fiber to form reinforcing rods, and positioning the rods above the deck panels.

15. The method of claim 9 and including the step of anchoring a plurality of generally vertical studs to a beam supporting the deck panels, and projecting the studs upwardly above the base walls of the deck panels for embedding the studs into the concrete layer.

16. The method of claim 9 and including the step of protruding longitudinally extending and laterally projecting ears on each of the ribs of each of the deck panels to aid in forming a positive bond of the concrete layer to the deck panels.

17. A composite deck system suited for use on a bridge, comprising a plurality of elongated deck panels of a composite, fiber-reinforced, plastics material, each of said deck panels having a generally flat base wall and at least one upwardly projecting longitudinally extending rib, said deck panels being assembled in laterally adjacent relation to provide a permanent deck form, a layer of concrete overlying said assembled deck panels, and said concrete layer is bonded to said deck panels.

18. A deck system as defined in claim 17 wherein said rib of each of said deck panels is tubular and is closed by said base wall, and each said tubular rib has spaced side walls with opposite outer side surfaces converging toward said base wall.

19. A deck system as defined in claim 18 wherein said side walls of each said rib comprise longitudinally extending and laterally projecting ears which cooperate with said converging side surfaces for forming a positive bond of said concrete layer to said deck panels.

20. A deck system as defined in claim 17 wherein each said deck panel has a top surface coated with a layer of adhesive and aggregate material, and said layer of adhesive and aggregate material is cured and hardened to provide a positive bond between said concrete layer and said deck panel.

21. A deck system as defined in claim 17 wherein said base wall of each said deck panel has a longitudinally extending offset edge portion for overlapping with an opposite edge portion of an adjacent said deck panel.

22. A deck system as defined in claim 17 and including a mat of elongated composite rods each having resin bonded longitudinally extending fibers and positioned in spaced relation above said deck panels for reinforcing an upper portion of said concrete layer.

23. A deck system as defined in claim 17 and including a plurality of generally vertical studs welded to a beam supporting said deck panels, and said studs project upwardly above said base walls of said deck panels and are embedded within said concrete layer.

24. A deck system as defined in claim 17 wherein each of said deck panels includes a plurality of parallel spaced and longitudinally extending said ribs, and said ribs have longitudinally extending ears projecting laterally into said concrete layer to aid in forming a positive bond of said concrete layer to said deck panels.

* * * * *